US006578633B2

(12) United States Patent
Slup et al.

(10) Patent No.: US 6,578,633 B2
(45) **Date of Patent: *Jun. 17, 2003**

(54) DRILLABLE BRIDGE PLUG

(75) Inventors: Gabriel Slup, Spring, TX (US); Douglas J. Lehr, The Woodlands, TX (US)

(73) Assignee: BJ Services Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/844,512

(22) Filed: Apr. 27, 2001

(65) Prior Publication Data

US 2002/0029880 A1 Mar. 14, 2002

Related U.S. Application Data

(63) Continuation-in-part of application No. 09/608,052, filed on Jun. 30, 2000.

(51) Int. Cl.[7] ..... E21B 23/00
(52) U.S. Cl. ..... 166/118; 166/134; 166/217
(58) Field of Search ..... 166/382, 387, 166/118, 134, 135, 192, 217

(56) References Cited

U.S. PATENT DOCUMENTS

| | | | | |
|---|---|---|---|---|
| 1,684,266 A | | 9/1928 | Fisher et al. | |
| RE21,677 E | | 12/1940 | Tremolada | 255/19 |
| 3,076,509 A | | 2/1963 | Burns et al. | 166/70 |
| 3,299,995 A | * | 1/1967 | Page, Jr. | 166/134 |
| 3,479,829 A | | 11/1969 | Goodman | 61/53.6 |
| 3,687,196 A | | 8/1972 | Mullins | 166/217 |
| 3,720,264 A | | 3/1973 | Hutchison | 166/311 |
| 3,727,691 A | | 4/1973 | Muecke et al. | 166/295 |
| 3,750,749 A | | 8/1973 | Giroux | 166/95 |
| 3,828,852 A | | 8/1974 | Delano | 166/78 |
| 3,971,436 A | | 7/1976 | Lee | 166/70 |
| 4,151,875 A | | 5/1979 | Sullaway | 166/126 |
| 4,190,111 A | | 2/1980 | Davis | 166/291 |
| 4,258,788 A | | 3/1981 | Patton et al. | 166/185 |
| 4,266,620 A | | 5/1981 | Wolgamott et al. | 175/215 |
| 4,349,071 A | | 9/1982 | Fish | 166/124 |
| 4,427,065 A | | 1/1984 | Watson | 166/250 |
| 4,520,879 A | | 6/1985 | MacElvain | 173/57 |
| 4,708,202 A | | 11/1987 | Sukup et al. | 166/123 |
| 4,722,389 A | | 2/1988 | Arnold | 166/70 |
| 5,224,540 A | | 7/1993 | Streich et al. | 166/118 |
| 5,271,468 A | | 12/1993 | Streich et al. | 166/387 |
| 5,390,737 A | | 2/1995 | Jacobi et al. | 166/184 |
| 5,413,172 A | | 5/1995 | Laurel | 166/153 |
| 5,451,084 A | | 9/1995 | Jansch | 294/1.1 |
| 5,540,279 A | | 7/1996 | Branch et al. | 166/118 |
| 5,669,448 A | | 9/1997 | Minthorn et al. | 166/308 |
| 5,701,959 A | | 12/1997 | Hushbeck et al. | 166/387 |
| 5,839,515 A | | 11/1998 | Yuan et al. | 166/387 |
| 5,865,251 A | | 2/1999 | Rebardi et al. | 166/278 |
| 5,984,007 A | | 11/1999 | Yuan et al. | 166/134 |
| 6,167,963 B1 | | 1/2001 | McMahan et al. | 166/179 |
| 6,220,349 B1 | | 4/2001 | Vargus et al. | 166/138 |

OTHER PUBLICATIONS

Halliburton's "FAS DRILL" product sheets (FAS DRILL®Frac Plug, ©1999 Halliburton Energy Services, Inc.; FAS DRILL® Squeeze Packers and Sliding–Valve Packers, ©1997 Halliburton Energy Services, Inc.; FAS DRILL® Bridge Plugs, ©1997 Halliburton Energy Services, Inc.)

(List continued on next page.)

*Primary Examiner*—William Neuder

(57) ABSTRACT

A method and apparatus for use in a subterranean well is described. The apparatus typically includes a subterranean plug including a mandrel having an outer surface and a non-circular cross-section and a packing element arranged about the mandrel, the packing element having a non-cylindrical inner surface matching the mandrel outer surface such that concentric rotation between the mandrel and the packing element is precluded. The apparatus may include slips having cavities to facilitate quick drill-out of the plug.

74 Claims, 6 Drawing Sheets

OTHER PUBLICATIONS

Baker, "A Primer of Oilwell Drilling", Sixth Edition, published by Petroleum Extension Service in cooperation with International Association of Drilling Contractors, 2001; first published 1951.

Long, Improved Completion Method for Mesaverde–Meeteetse Wells in the Wind River Basin, SPE 60312, Copyright 1999.

Savage, "Taking New Materials Downhole—The Composite Bridge Plug", PNEC 662,935 (1994).

Guoynes, "New Composite Fracturing Plug Improves Efficiency in Coalbed Methane Completions" SPE 40052, Copyright 1998.

Baker Hughes' web page for "QUIK Drill™ Composite Bridge Plug" (Jul. 16, 2002).

Baker Prime Fiberglass Packer Prod. 739–09 data sheet.

Jun. 1968 World Oil Advertisement, p. 135 for Baker All–Fiberglass Packer.

Society of Plastics, www.socplas.org).

"Tape–laying precision industrial shafts", by Debbie Stover, Senior Editor; HIGH–PERFORMANCE Composites Jul./Aug. 1994.

Baker Service Tools Catalog, p. 26, [date unknown] "Compact Bridge Plug Model P–1."

Baker Service Tools Catalog, p. 6, Unit No. 4180, Apr. 26, 1985, "E–4 Wireline Pressure Setting Assembly."

Baker Oil Tools Catalog, 1998, "Quik Drill Composite Bridge Plug."

Baker Service Tools Catalog, p. 26, [date unknown] "Model T Compact Wireline Bridge Plug."

Baker Service Tools Catalog, p. 24 [date unknown] "Model S, N–1, and NC–1 Wireline Bridge Plugs."

Baker Sand Control Catalog for Gravel Pack Systems; ©1988.

Offshore Technology Conference papers OTC 7022, "Horizontal Well Completing, Oseberg Gamma North," Bjorkeset et al; © 1992.

"Water–packing Techniques Successful in Gravel Packing High–Angle Wells," Douglas J. Wilson and Mark F. Barrilleaux, Oil and Gas Journal © 1991.

* cited by examiner

DRILLABLE BRIDGE PLUG

CROSS-REFERENCE TO RELATED APPLICATIONS

This application is a continuation-in-part of application Ser. No. 09/608,052, filed Jun. 30, 2000, entitled "Drillable Bridge Plug," incorporated herein in its entirety by reference.

BACKGROUND OF THE INVENTION

1. Field of the Invention

This invention relates generally to methods and apparatus for drilling and completing subterranean wells and, more particularly, to methods and apparatus for a drillable bridge plug and other related downhole apparatus.

2. Description of Related Art

There are many applications in well drilling, servicing, and completion in which it becomes necessary to isolate particular zones within the well. In some applications, such as cased-hole situations, conventional bridge plugs such as the Baker Hughes model T, N1, NC1, P1, or S wireline-set bridge plugs are inserted into the well to isolate zones. The bridge plugs may be temporary or permanent; the purpose of the plugs is simply to isolate some portion of the well from another portion of the well. In some instances perforations in the well in one portion need to be isolated from perforations in another portion of the well. In other situations there may be a need to use a bridge plug to isolate the bottom of the well from the wellhead. There are also situations where these plugs are not used necessarily for isolation but instead are used to create a cement plug in the wellbore which may be used for permanent abandonment. In other applications a bridge plug with cement on top of it may be used as a kickoff plug for side-tracking the well.

Bridge plugs may be drillable or retrievable. Drillable bridge plugs are typically constructed of a brittle metal such as cast iron that can be drilled out. One typical problem with conventional drillable bridge plugs is that without some sort of locking mechanism, the bridge plug components tend to rotate with the drill bit, which may result in extremely long drill-out times, excessive casing wear, or both. Long drill-out times are highly undesirable as rig time is typically charged for by the hour.

Another typical problem with conventional drillable plugs is that the conventional metallic construction materials, even though brittle, are not easy to drill through. The plugs are generally required to be quite robust to achieve an isolating seal, but the materials of construction may then be difficult to drill out in a reasonable time. These typical metallic plugs thus require that significant weight be applied to the drill-bit in order to drill the plug out. It would be desirable to create a plug that did not require significant forces to be applied to the drill-bit such that the drilling operation could be accomplished with a coiled tubing motor and bit; however, conventional metallic plugs do not enable this.

In addition, when several plugs are used in succession to isolate a plurality of zones within the wellbore, there may be significant pressures on the plug from either side. It would be desirable to design an easily drilled bridge plug that is capable of holding high differential pressures on both sides of the plug. Also, with the potential for use of multiple plugs in the same wellbore, it would be desirable to create a rotational lock between plugs. A rotational lock between plugs would facilitate less time-consuming drill outs.

The present invention is directed to overcoming, or at least reducing the effects of, one or more of the issues set forth above.

SUMMARY OF THE INVENTION

In one embodiment a subterranean apparatus is disclosed. The apparatus may include a mandrel having an outer surface and a non-circular cross-section and a packing element arranged about the mandrel, the packing element having a non-cylindrical inner surface such that rotation between the mandrel and the packing element is precluded. The mandrel may include non-metallic materials, for example carbon fiber.

In one embodiment, the apparatus exhibits a non-circular cross-section that is hexagonally shaped. The interference between the non-circular outer surface of the mandrel and the inner surface of the packing element comprise a rotational lock.

In one embodiment the apparatus includes an anchoring assembly arranged about the mandrel, the anchoring assembly having a non-circular inner surface such that rotation between the mandrel and the anchoring assembly is precluded. The anchoring assembly may further include a first plurality of slips arranged about the non-circular mandrel outer surface, the slips being configured in a non-circular loop such that rotation between the mandrel and the slips is precluded by interference between the loop shape and the mandrel outer surface shape. The first plurality of slips may include non-metallic materials. The first plurality of slips may each include a metallic insert mechanically attached to and/or integrally formed into each of the plurality of slips wherein the metallic insert is engagable with a wellbore wall. The anchoring assembly may also include a first cone arranged about the mandrel, the first cone having a non-circular inner surface such that rotation between the mandrel and the first cone is precluded by interference between the first cone inner surface shape and the mandrel outer surface shape. The first plurality of slips abuts the first cone, facilitating radial outward movement of the slips into engagement with a wellbore wall upon traversal of the plurality of slips along the first cone. In is this embodiment, the first cone may include non-metallic materials. At least one shearing device may be disposed between the first cone and the mandrel, the sharing device being adapted to shear upon the application of a predetermined force.

The anchoring assembly of the apparatus may further include a second plurality of slips arranged about the non-circular outer surface of the mandrel, the second plurality of slips, the slips being configured in a non-circular loop such that rotation between the mandrel and the slips is precluded by interference between the loop shape and the mandrel outer surface shape. The second plurality of slips may include non-metallic materials. The second plurality of slips may each include a metallic insert mechanically attached to and/or integrally formed therein with the metallic inserts being engagable with the wellbore wall. The anchoring assembly may also include a second collapsible cone arranged about the non-circular outer surface of the mandrel, the second collapsible cone having a non-circular inner surface such that rotation between the mandrel and the second cone is precluded by interference between the second cone inner surface shape and the mandrel outer surface shape, wherein the second plurality of slips abuts the second collapsible cone, facilitating radial outward movement of the slips into engagement with the wellbore wall upon traversal of the plurality of slips along the second collapsible cone. The second collapsible cone may include non-metallic materials. The second collapsible cone may be adapted to collapse upon the application of a predetermined force. The second collapsible cone may include at least one metallic insert mechanically attached to and/or integrally formed therein, the at least one metallic insert facilitating a locking engagement between the cone and the mandrel. The anchoring assembly may include at least one shearing device disposed between the second collapsible cone and the mandrel, the at least one shearing device being adapted to shear upon the application of a predetermined force.

In one embodiment the packing element is disposed between the first cone and the second collapsible cone. In one embodiment a first cap is attached to a first end of the mandrel. The first cap may include non-metallic materials. The first cap may be attached to the mandrel by a plurality of non-metallic pins.

In one embodiment the first cap may abut a first plurality of slips. In one embodiment the packing element includes a first end element, a second end element, and a elastomer disposed therebetween. The elastomer may be adapted to form a seal about the non-circular outer surface of the mandrel by expanding radially to seal with the wall of the wellbore upon compressive pressure applied by the first and second end elements.

In one embodiment the apparatus may include a second cap attached to a second end of the mandrel. The second cap may include non-metallic materials. The second cap may be attached to the mandrel by a plurality of non-metallic pins. In this embodiment, the second cap may abut a second plurality of slips. In one embodiment the first end cap is adapted to rotationally lock with a second mandrel of a second identical apparatus such as a bridge plug.

In one embodiment the apparatus includes a hole in the mandrel extending at least partially therethrough. In another embodiment the hole extends all the way through the mandrel. In the embodiment with the hole extending all the way therethrough, the mandrel may include a valve arranged in the hole facilitating the flow of cement or other fluids, gases, or slurries through the mandrel, thereby enabling the invention to become a cement retainer.

In one embodiment there is disclosed a subterranean apparatus including a mandrel having an outer surface and a non-circular cross-section, and an anchoring assembly arranged about the mandrel, the anchoring assembly having a non-circular inner surface such that rotation between the mandrel and the anchoring assembly is precluded as the outer surface of the mandrel and inner surface of the packing element interfere with one another in rotation.

In one embodiment there is disclosed a subterranean apparatus including a mandrel; a first cone arranged about an outer diameter of the mandrel; a first plurality of slips arranged about first cone; a second cone spaced from the first cone and arranged about the outer diameter of the mandrel; a second plurality of slips arranged about the first cone; a metallic insert disposed in an inner surface of the second cone and adjacent to the mandrel; a packing element disposed between the first and second cones; with the first and second pluralities of slips being lockingly engagable with the wall of a wellbore and the metallic insert being lockingly engagable with the mandrel. In this embodiment the second cone may be collapsible onto the mandrel upon the application of a predetermined force. The mandrel, cones, and slips may include non-metallic materials. In addition, a cross-section of the mandrel is non-circular and the inner surfaces of the cones, slips, and packing element are non-circular and may or may not match the outer surface of the mandrel.

In one embodiment there is disclosed a slip assembly for use on subterranean apparatus including: a first cone with at least one channel therein; a first plurality of slips, each having an attached metallic insert, the first slips being arranged about the first cone in the at least one channel of the first cone; a second collapsible cone having an interior surface and an attached metallic insert disposed in the interior surface; a second plurality of non-metallic slips, each having an attached metallic insert, the second slips being arranged about the second cone; with the second non-metallic collapsible cone being adapted to collapse upon the application of a predetermined force. In this embodiment the first and second pluralities of slips are adapted to traverse first and second cones until the slips lockingly engage with a wellbore wall. The insert of the second non-metallic cone is adapted to lockingly engage with a mandrel upon the collapse of the cone. Each of first and second cones and first and second pluralities of slips may include non-metallic materials.

There is also disclosed a method of plugging or setting a packer in a well. The method may include the steps of: running an apparatus into a well, the apparatus comprising a mandrel with a non-cylindrical outer surface and a packing element arranged about the mandrel; setting the packing element by the application force delivered from conventional setting tools and means including, but not limited to: wireline pressure setting tools, mechanical setting tools, and hydraulic setting tools; locking the apparatus in place within the well; and locking an anchoring assembly to the mandrel. According to this method the apparatus may include a first cone arranged about the outer surface of the mandrel; a first plurality of slips arranged about the first cone; a second cone spaced from the first cone and arranged about the outer diameter of the mandrel; a second plurality of slips arranged about the second cone; a metallic insert disposed in an inner surface of the second cone and adjacent to the mandrel; with the first and second pluralities of slips being lockingly engagable with the wall of a wellbore and the metallic insert being lockingly engagable with the mandrel. The first and second cones may include a plurality of channels receptive of the first and second pluralities of slips. Also according to this method, the step of running the apparatus into the well may include running the apparatus such as a plug on wireline. The step of running the apparatus into the well may also include running the apparatus on a mechanical or hydraulic setting tool. The step of locking the apparatus within the well may further include the first and second pluralities of slips traversing the first and second cones and engaging with a wall of the well. The step of locking the anchoring assembly to the mandrel may further include collapsing the second cone and engaging the second cone metallic insert with the mandrel.

There is also disclosed a method of drilling out a subterranean apparatus such as a plug including the steps of: running a drill into a wellbore; and drilling the apparatus; where the apparatus is substantially non-metallic and includes a mandrel having a non-cylindrical outer surface; and a packing element arranged about the mandrel, the packing element having a non-cylindrical inner surface matching the mandrel outer surface. According to this method, the step of running the drill into the wellbore may be accomplished by using coiled tubing. Also, drilling may be accomplished by a coiled tubing motor and bit.

In one embodiment there is disclosed an adapter kit for a running a subterranean apparatus including: a bushing adapted to connect to a running tool; a setting sleeve attached to the bushing, the setting sleeve extending to the subterranean apparatus; a setting mandrel interior to the setting sleeve; a support sleeve attached to the setting mandrel and disposed between the setting mandrel and the setting sleeve; and a collet having first and second ends, the first end of the collet being attached to the setting mandrel and the second end of the collet being releasably attached to the subterranean apparatus. According to this adapter kit the subterranean apparatus may include an apparatus having a packing element and an anchoring assembly. The subterranean apparatus may include a plug, cement retainer, or packer. The anchoring assembly may be set by the transmission of force from the setting sleeve to the anchoring assembly. In addition, the packing element may be set by the transmission of force from the setting sleeve, through the anchoring assembly, and to the packing element. According to this embodiment the collet is locked into engagement with the subterranean apparatus by the support sleeve in a first position. The support sleeve first position may be facilitated by a shearing device such as shear pins or shear rings. The support sleeve may be movable into a second position upon the application of a predetermined force to shear the shear pin. According to this embodiment, the collet may be unlocked from engagement with the subterranean apparatus by moving the support sleeve to the second position.

In one embodiment there is disclosed a bridge plug for use in a subterranean well including: a mandrel having first and second ends; a packing element; an anchoring assembly; a first end cap attached to the first end of the mandrel; a second end cap attached to the second end of the mandrel; where the first end cap is adapted to rotationally lock with the second end of the mandrel of another bridge plug. According to this embodiment, each of mandrel, packing element, anchoring assembly, and end caps may be constructed of substantially non-metallic materials.

In some embodiments, the first and/or the second plurality of slips of the subterranean apparatus include cavities that facilitate the drilling out operation. In some embodiments, these slips are comprised of cast iron.

BRIEF DESCRIPTION OF THE DRAWINGS

The foregoing and other features and aspects of the invention will become further apparent upon reading the following detailed description and upon reference to the drawings in which:

FIG. 21A shows a side view of a slip of one embodiment of the present invention.

FIG. 21B shows a cross-section of a slip having a cavity of one embodiment of the present invention.

FIG. 21C shows a bottom view of a slip of one embodiment of the present invention.

FIG. 21D shows a top view of a slip of one embodiment of the present invention.

Figure 6:
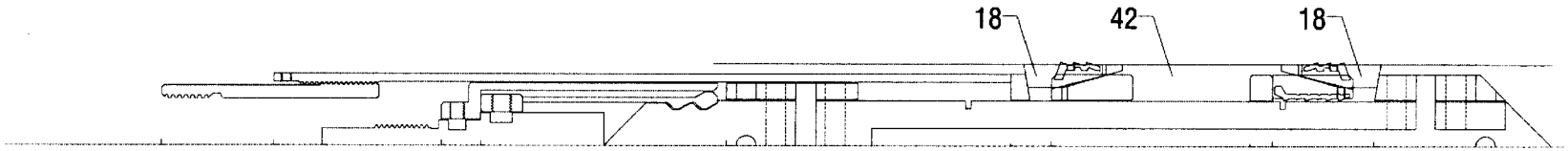
FIG. 6 is a simplified view of the subterranean apparatus and adapter kit according to FIG. 1, shown in a third position.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Figure 2:
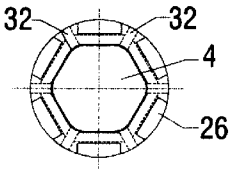
FIG. 2 is a top cross-sectional view of the subterranean apparatus through the upper slip and cone, according to FIG. 1.
Figure 1:
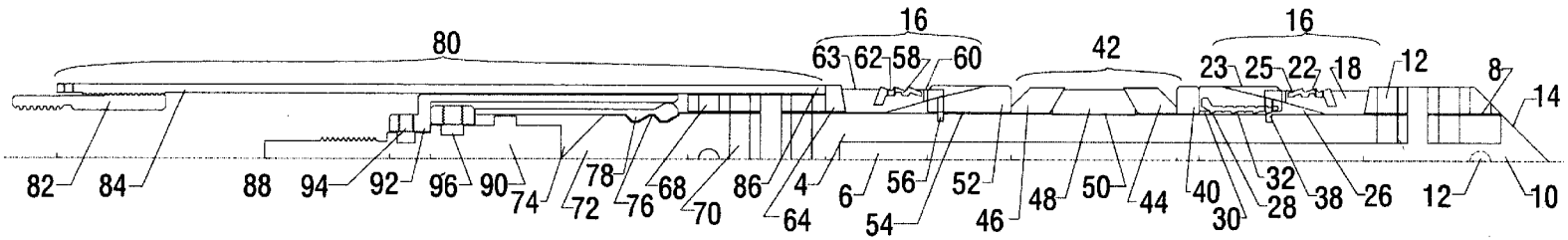
FIG. 1 is a simplified view of a subterranean apparatus and adapter kit assembly positioned in a wellbore according to one embodiment of the present invention.
Figure 13A:
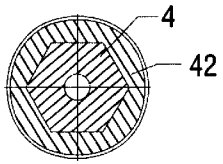
FIG. 13A is a cross-sectional view of the subterranean apparatus assembly according to FIG. 13 taken along line A—A.
Figure 13:
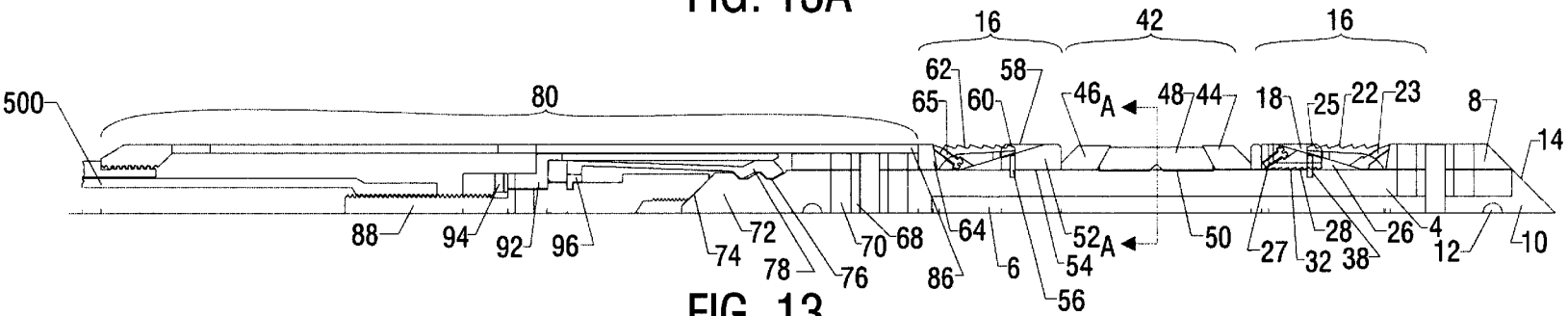
FIG. 13 is a simplified view of the subterranean apparatus assembly and adapter kit according to FIG. 11, shown in a third position.
Figure 14:
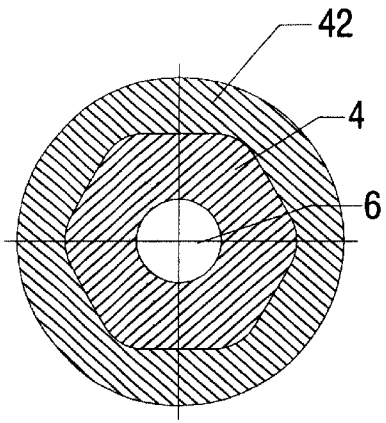
FIG. 14 is a top cross-sectional view of the subterranean apparatus through the mandrel and packing element, an alternative embodiment of the present invention.

Turning now to the drawings, and in particular to FIGS. 1 and 13, a subterranean plug assembly 2 in accordance with one embodiment of the disclosed method and apparatus is shown. Plug assembly 2 is shown in the running position in FIGS. 1 and 13. Plug assembly 2 is shown as a bridge plug, but it may be modified as described below to become a cement retainer or other plug. Plug assembly 2 includes a mandrel 4 constructed of non-metallic materials. The non-metallic materials may be a composite, for example a carbon fiber reinforced material or other material that has high strength yet is easily drillable. Carbon fiber materials for construction of mandrel 4 may be obtained from ADC Corporation and others, for example XC-2 carbon fiber available from EGC Corporation. Mandrel 4 has a non-circular cross-section as shown in FIG. 2. The cross-section of the embodiment shown in FIGS. 1–13 is hexagonal; however, it will be understood by one of skill in the art with the benefit of this disclosure that any non-circular shape may be used. Other non-circular shapes include, but are not limited to, an ellipse, a triangle, a spline, a square, or an octagon. Any polygonal, elliptical, spline, or other non-circular shape is contemplated by the present invention. FIGS. 14–17 disclose some of the exemplary shapes of the cross-section of mandrel 4 and the outer components. FIG. 14 discloses a hexagonal mandrel 4, FIG. 15 discloses an elliptical mandrel 4, FIG. 16 discloses a splined mandrel 4, and FIG. 17 discloses a semi-circle and flat mandrel. In one embodiment mandrel 4 may include a hole 6 partially therethrough. Hole 6 facilitates the equalization of well pressures across the plug at the earliest possible time if and when plug assembly 2 is drilled out. One of skill in the art with the benefit of this disclosure will recognize that it is desirable in drilling operations to equalize the pressure across the plug as early in the drilling process as possible.

Mandrel 4 is the general support for each of the other components of plug assembly 2. The non-circular cross-section exhibited by mandrel 4 advantageously facilitates a rotational lock between the mandrel and all of the other components (discussed below). That is, if and when it becomes necessary to drill out plug assembly 2, mandrel 4 is precluded from rotating with the drill, the non-circular cross-section of mandrel 4 prevents rotation of the mandrel with respect to the other components which have surfaces interfering with the cross-section of the mandrel.

Attached to a first end 8 of mandrel 4 is a first end cap 10. First end cap 10 is a non-metallic composite that is easily drillable, for example an injection molded phenolic or other similar material. First end cap 10 may be attached to mandrel 4 by a plurality of non-metallic composite pins 12, and/or attached via an adhesive. Composite pins 12 are arranged in different planes to distribute any shear forces transmitted thereto. First end cap 10 prevents any of the other plug components (discussed below) from sliding off first end 8 of mandrel 4. First end cap 10 may include a locking mechanism, for example tapered surface 14, that rotationally locks plug assembly 2 with another abutting plug assembly (not shown) without the need for a third component such as a key. This rotational lock facilitates the drilling out of more than one plug assembly when a series of plugs has been set in a wellbore. For example, if two plug assemblies 2 are disposed in a wellbore at some distance apart, as the proximal plug is drilled out, any remaining portion of the plug will fall onto the distal plug, and first end cap 10 will rotationally lock with the second plug to facilitate drilling out the remainder of the first plug before reaching the second plug. In the embodiment shown in the figures, first end cap 10 exhibits an internal surface matching the non-circular cross-section of mandrel 4 which creates a rotational lock between the end cap and mandrel; however, the internal surface of the first end cap 10 may be any non-circular surface that precludes rotation between the end cap and mandrel 4. For example, the internal surface of first end cap 10 may be square, while mandrel 4 has an outer surface that is hexagonal or octagonal, but rotation between the two is still advantageously precluded without the need for a third component such as a key.

First end cap 10 abuts an anchoring assembly 16. Anchoring assembly 16 includes a first plurality of slips 18 arranged about the outer diameter of mandrel 4. Slips 18 are arranged in a ring shown in FIG. 3 with the slips being attached to one another by slip ring 20. In the embodiment shown in FIG. 3, there are six slips 18 arranged in a hexagonal configuration to match the cross-section of mandrel 4. It will be understood by one of skill in the art with the benefit of this disclosure that slips 18 may be arranged in any configuration matching the cross-section of mandrel 4, which advantageously creates a rotational lock such that slips 18 are precluded from rotating with respect to mandrel 4. In addition, the number of slips may be varied and the shape of slip ring may be such that rotation would be allowed between the slips and the mandrel—but for the channels 99 (discussed below). Further, the configuration of slip ring 20 may be any non-circular shape that precludes rotation between slips 18 and mandrel 4. For example, the slip ring 20 may be square, while mandrel 4 has an outer surface that is hexagonal or octagonal, but rotation between the two is still precluded. Each of slips 18 is constructed of non-metallic composite materials such as injection molded phenolic, but each slip also includes a metallic insert 22 disposed in outer surface 23. Metallic inserts 22 may each have a wicker design as shown in the figures to facilitate a locked engagement with a casing wall 24. Metallic inserts 22 may be molded into slips 18 such that slips 18 and inserts 22 comprise a single piece as shown in FIG. 1; however, as shown in the embodiment shown in FIGS. 11–13, metallic inserts 22 may also be mechanically attached to slips 18 by a fastener, for example screws 23. Metallic inserts 22 are constructed of low density metallic materials such as cast iron, which may heat treated to facilitate surface hardening such that inserts 22 can penetrate casing 24, while maintaining small, brittle portions such that they do not hinder drilling operations. Metallic inserts 22 may be integrally formed with slips 18, for example, by injection molding the composite material that comprises slips 18 around metallic insert 22.

Anchoring assembly 16 also includes a first cone 26 arranged adjacent to the first plurality of slips 18. A portion of slips 18 rest on fist cone 26 as shown in the running position shown in FIGS. 1 and 13. First cone 26 comprises non-metallic composite materials such as phenolics that are easily drillable. First cone 26 includes a plurality of metallic inserts 28 disposed in an inner surface 30 adjacent mandrel 4. In the running position shown in FIGS. 1 and 13, there is a gap 32 between metallic inserts 28 and mandrel 4. Metallic inserts 28 may each have a wicker design as shown in the figures to facilitate a locked engagement with mandrel 4 upon collapse of first cone 26. Metallic inserts 28 may be molded into first cone 26 such that first cone 26 and metallic inserts 28 comprise a single piece as shown in FIG. 1; however, as shown in the embodiment shown in FIGS. 11–13, metallic inserts 28 may also be mechanically attached to first cone 26 by a fastener, for example screws 27. Metallic inserts 28 may be constructed of low density metallic materials such as cast iron, which may be heat treated to facilitate surface hardening sufficient to penetrate mandrel 4, while maintaining small, brittle portions such that the inserts do not hinder drilling operations. For example, metallic inserts 28 may be surface or through hardened to approximately plus or minus fifty-five Rockwell C hardness. Metallic inserts 28 may be integrally formed with first cone 26, for example, by injection molding the composite material that comprises first cone 26 around metallic inserts 28 as shown in FIG. 1; however, as shown in the embodiment shown in FIGS. 11–13, metallic inserts 28 may also be mechanically attached to first cone 26 by a fastener, for example screws 27. Inner surface 30 of first cone 26 may match the cross-section of mandrel 4 such that there is an advantageous rotational lock therebetween. In the embodiment shown in FIGS. 2 and 4, inner surface 30 is shaped hexagonally to match the cross-section of mandrel 4. However, it will be understood by one of skill in the art with the benefit of this disclosure that inner surface 30 of cone 26 may be arranged in any configuration matching the cross-section of mandrel 4. The matching of inner surface 30 and mandrel 4 cross-section creates a rotational lock such that mandrel 4 is precluded from rotating with respect to first cone 26. In addition, however, the inner surface 30 of the first cone 26 may not match and instead may be any non-circular surface that precludes rotation between the first cone and mandrel 4. For example, the inner surface 30 may be square, while mandrel 4 has an outer surface that is hexagonal or octagonal, but rotation between the two is still advantageously precluded without the need for a third component such as a key.

Figure 4:
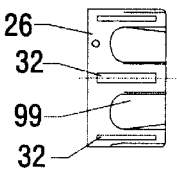
FIG. 4 is a side view of a cone assembly according to one embodiment of the disclosed method and apparatus.
Figure 3:
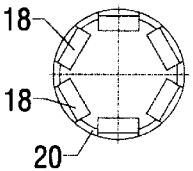
FIG. 3 is a top view of a slip ring according to one embodiment of the disclosed method and apparatus.
Figure 7:
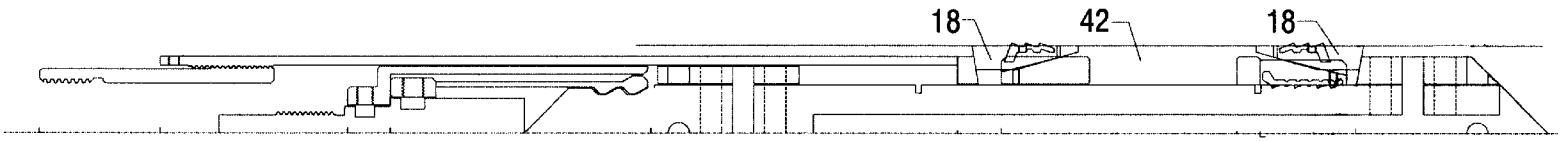
FIG. 7 is a simplified view of the subterranean apparatus and adapter kit according to FIG. 1, shown in a fourth position.
Figure 12:
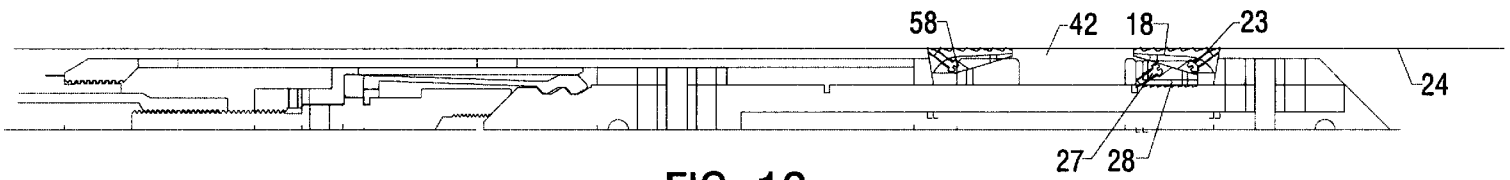
FIG. 12 is a simplified view of the subterranean apparatus assembly and adapter kit according to FIG. 11, shown in a second position.

As shown in FIG. 4, first cone 26 includes a plurality of slots 32 disposed therein, for example six slots. Slots 32 weaken first cone 26 such that the cone will collapse at a predetermined force. The predetermined collapsing force on first cone 26 may be, for example, approximately 4500 pounds; however, first cone 26 may be designed to collapse at any other desirable force. When first cone 26 collapses, as shown in FIGS. 7 and 12, metallic inserts 28 penetrate mandrel 4 and preclude movement between anchoring assembly 16 and mandrel 4. As shown in FIGS. 1 and 13, one or more shearing devices, for example shear pins 38, may extend between first cone 26 and mandrel 4. Shear pins 38 preclude the premature setting of anchoring assembly 16 in the wellbore during run-in. Shear pins 38 may be designed to shear at a predetermined force. For example, shear pins 38 may shear at a force of approximately 1500 pounds; however, shear pins 38 may be designed to shear at any other desirable force. As shear pins 38 shear, further increases in force on first cone 26 will cause relative movement between first cone 26 and first slips 18. FIG. 6 shows the shearing of shear pins 38. The relative movement between first cone 26 and first slips 18 causes first slips 18 to move in a radially outward direction and into engagement with casing wall 24. At some point of the travel of slips 18 along first cone 26, slip ring 20 will break to allow each of slips 18 to engage casing wall 24. For example, slip ring 20 may break between 1500 and 3000 pounds, with slips 18 being fully engaged with casing wall 24 at 3000 pounds. FIGS. 6 and 12 show plug assembly 2 with slips 18 penetrating casing wall 24. FIG. 4 also discloses a plurality of channels 99 formed in first cone 26. Each of channels 99 is associated with its respective slip 18. Channels 99 advantageously create a rotational lock between slips 18 and first cone 26.

First cone 26 abuts a gage ring 40. Gage ring 40 may be non-metallic, comprised, for example, of injection molded phenolic. Gage ring 40 prevents the extrusion of a packing element 42 adjacent thereto. Gage ring 40 includes a non-circular inner surface 41 that precludes rotation between the gage ring and mandrel 4. For example inner surface 41 may be hexagonal, matching a hexagonal outer surface of mandrel 4, but inner surface 41 is not limited to a match as long as the shape precludes rotation between the gage ring and the mandrel.

Packing element 42 may include three independent pieces. Packing element 42 may include first and second end elements 44 and 46 with an elastomeric portion 48 disposed therebetween. First and second end elements 44 and 46 may include a wire mesh encapsulated in rubber or other elastomeric material. Packing element 42 includes a non-cylindrical inner surface 50 that may match the cross-section of mandrel 4, for example, as shown in the figures, inner surface 50 is hexagonal. The match between non-cylindrical surface 50 of packing element 42 and the cross-section of mandrel 4 advantageously precludes rotation between the packing element and the mandrel as shown in any of FIGS. 14–17. However, the non-cylindrical surface 50 of packing element 42 may be any non-circular surface that precludes rotation between the packing element and mandrel 4. For example, the surface 50 may be hexagonal, while mandrel 4 has an outer surface that is octagonal, but rotation between the two is still precluded. Packing element 42 is predisposed to a radially outward position as force is transmitted to the end elements 44 and 46, urging packing element 42 into a sealing engagement with casing wall 24 and the outer surface of mandrel 4. Packing element 42 may seal against casing wall 24 at, for example, 5000 pounds.

End element 46 of packing element 42 abuts a non-metallic second cone 52. Second cone 52 includes non-metallic composite materials that are easily drillable such as phenolics. Second cone 52 is a part of anchoring assembly 16. Second cone 52, similar to first cone 26, may include a non-cylindrical inner surface 54 matching the cross-section of mandrel 4. In the embodiment shown in the figures, inner surface 54 is hexagonally shaped. The match between inner surface 54 precludes rotation between mandrel 4 and second cone 52. However, inner surface 54 may be any non-circular surface that precludes rotation between second cone 52 and mandrel 4. For example, inner surface 54 may be square, while mandrel 4 has an outer surface that is hexagonal or octagonal, but rotation between the two is still precluded. In one embodiment, second cone 52 does not include any longitudinal slots or metallic inserts as first cone 26 does; however, in an alternative embodiment second cone 52 does include the same elements as first cone 26. Second cone 52 includes one or more shearing devices, for example shear pins 56, that prevent the premature setting of a second plurality of slips 58. Shear pins 56 may shear at, for example approximately 1500 pounds. FIG. 4 also discloses that second cone 52 includes a plurality of channels 99 formed therein. Each of channels 99 is associated with its respective slip 58. Channels 99 advantageously create a rotational lock between slips 58 and second cone 52.

Anchoring assembly 16 further includes the second plurality of slips 58 arranged about the outer diameter of mandrel 4. Slips 58 are arranged in a ring shown in FIG. 3 with the slips being attached to one another by slip ring 60. In the embodiment shown in FIG. 3, there are six slips 58 arranged in a hexagonal configuration to match the cross-section of mandrel 4. It will be understood by one of skill in the art with the benefit of this disclosure that slips 58 may be arranged in any configuration matching the cross-section of mandrel 4, which advantageously creates a rotational lock such that slips 58 are precluded from rotating with respect to mandrel 4. Further, the configuration of slip ring 60 may be any non-circular shape that precludes rotation between slips 58 and mandrel 4. For example, the slip ring 60 may be square, while mandrel 4 has an outer surface that is hexagonal or octagonal, but rotation between the two is still precluded. In addition, the number of slips may be varied and the shape of slip ring may be such that rotation would be allowed between the slips and the mandrel—but for the channels 99. Each of slips 58 may be constructed of non-metallic composite materials, but each slip also includes a metallic insert 62 disposed in outer surface 63. Metallic inserts 62 may each have a wicker design as shown in the figures to facilitate a locked engagement with a casing wall 24. Metallic inserts 62 may be molded into slips 58 such that slips 58 and inserts 62 comprise a single piece as shown in FIG. 1; however, as shown in the embodiment shown in FIGS. 11–13, metallic inserts 62 may also be mechanically attached to slips 58 by a fastener, for example screws 65. Metallic inserts 62 may be constructed of low density metallic materials such as cast iron, which may heat treated to facilitate hardening such that inserts 62 can penetrate casing 24, while maintaining small, brittle portions such that they do not hinder drilling operations. For example, metallic inserts 62 may be hardened to approximately plus or minus fifty-five Rockwell C hardness. Metallic inserts 62 may be integrally formed with slips 58, for example, by injection molding the composite material that comprises slips 58 around metallic insert 62.

Adjacent slips 58 is a ring 64. Ring 64 is a solid non-metallic piece with an inner surface 66 that may match the cross-section of mandrel 4, for example inner surface 66 may be hexagonal. However, inner surface 66 may be any non-circular surface that precludes rotation between ring 64 and mandrel 4. For example, inner surface 66 may be square, while mandrel 4 has an outer surface that is hexagonal or octagonal, but rotation between the two is still precluded Ring 64, like the other components mounted to mandrel 4, may have substantially circular outer diameter. The match between inner surface 66 and the cross-section of mandrel 4 advantageously precludes rotation between ring 64 and mandrel 4.

Ring 64 abuts a second end cap 68. Second end cap 68 may be a non-metallic material that is easily drillable, for example injection molded phenolic or other similar material. Second end cap 68 may be attached to mandrel 4 by a plurality of non-metallic composite pins 70, and/or attached via an adhesive. Composite pins 70 are arranged in different planes to distribute any shear forces transmitted thereto. Second end cap 68 prevents any of the other plug components (discussed above) from sliding off second end 72 of mandrel 4. In the embodiment shown in the figures, second end cap 68 exhibits an internal surface matching the non-circular cross-section of mandrel 4 which creates a rotational lock between the end cap and mandrel; however, the internal surface of the second end cap 68 may be any non-circular surface that precludes rotation between the end cap and mandrel 4. For example, the internal surface of second end cap 68 may be square, while mandrel 4 has an outer surface that is hexagonal or octagonal, but rotation between the two is still precluded. Second end 72 of mandrel 4 may include a locking mechanism, for example tapered surface 74, that rotationally locks plug assembly 2 with another abutting plug assembly (not shown). Tapered surface 74 is engagable with tapered surface 14 of end cap 10 such that rotation between two plugs 2 is precluded when surfaces 74 and 14 are engaged.

Second end 72 of plug 2 includes two grooves 76 extending around mandrel 4. Grooves 76 are receptive of a collet 78. Collet 78 is part of an adapter kit 80. Adapter kit 80 includes a bushing 82 receptive of a setting tool 500 (not shown in FIG. 1, but shown in FIGS. 11–13). Bushing 82 is receptive, for example of a Baker E-4 wireline pressure setting assembly (not shown), but other setting tools available from Owen and Schlumberger may be used as well. The setting tools include, but are not limited to: wireline pressure setting tools, mechanical setting tools, and hydraulic setting tools. Adjacent bushing 82 is a setting sleeve 84. Setting sleeve 84 extends between the setting tool (not shown) and bridge plug 2. A distal end 86 of setting sleeve 84 abuts ring 64. Adapter kit 80 exhibits a second connection point to the setting tool (not shown) at the proximal end 88 of a setting mandrel 90. Setting mandrel 90 is part of adapter kit 80. Setting sleeve 84 and setting mandrel 90 facilitate the application of forces on plug 2 in opposite directions. For example setting sleeve 84 may transmit a downward force (to the right as shown in the figures) on plug 2 while setting mandrel 90 transmits an upward force (to the left as shown in the figures). The opposing forces enable compression of packing element 42 and anchoring assembly 16. Rigidly attached to setting mandrel 90 is a support sleeve 92. Support sleeve 92 extends the length of collet 78 between setting sleeve 84 and collet 78. Support sleeve 92 locks collet 78 in engagement with grooves 76 of mandrel 4. Collet 78 may be shearably connected to setting mandrel 90, for example by shear pins 96 or other shearing device such as a shear ring (not shown).

It will be understood by one of skill in the art with the benefit of this disclosure that one or more of the non-metallic components may include plastics that are reinforced with a variety of materials. For example, each of the non-metallic components may comprise reinforcement materials including, but not limited to, glass fibers, metallic powders, wood fibers, silica, and flour. However, the non-metallic components may also be of a non-reinforced recipe, for example, virgin Peek, Ryton, or Teflon polymers. Further, in some embodiments, the non-metallic components may instead be metallic component to suit a particular application. In a metallic-component situation, the rotational lock between components and the mandrel remains as described above.

Figure 5:
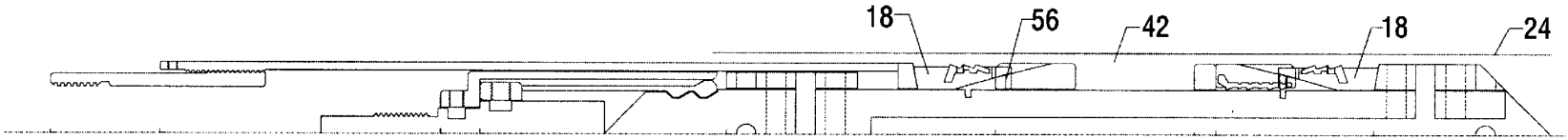
FIG. 5 is a simplified view of the subterranean apparatus and adapter kit according to FIG. 1, shown in a second position.

Operation and setting of plug 2 is as follows. Plug 2, attached to a setting tool via adapter kit 80, is lowered into a wellbore to the desired setting position as shown in FIGS. 1 and 13. Bushing 82 and its associated setting sleeve 84 are attached to a first portion of the setting tool (not shown) which supplies a downhole force. Setting mandrel 90, with its associated components including support sleeve 92 and collet 78, remain substantially stationary as the downhole force is transmitted through setting sleeve 84 to ring 64. The downhole force load is transmitted via setting sleeve 84 and ring 64 to shear pins 56 of second cone 52. At a predetermined load, for example a load of approximately 1500 pounds, shear pins 56 shear and packing element 42 begins its radial outward movement into sealing engagement with casing wall 24 as shown in FIG. 5. As the setting force from setting sleeve 84 increases and packing element 42 is compressed, second plurality of slips 58 traverses second cone 52 and eventually second ring 60 breaks and each of second plurality of slips 58 continue to traverse second cone 52 until metallic inserts 62 of each penetrates casing wall 24 as shown in FIGS. 6 and 12. Similar to the operation of anchoring slips 58, the load transmitted by setting sleeve 84 also causes shear pins 38 between first cone 26 and mandrel 4 to shear at, for example, approximately 1500 pounds, and allow first plurality of slips 18 to traverse first cone 26. First plurality of slips 18 traverse first cone 26 and eventually first ring 25 breaks and each of first plurality of slips 18 continue to traverse first cone 26 until metallic inserts 22 of each penetrates casing wall 24. Force supplied through setting sleeve 84 continues and at, for example, approximately 3000 pounds of force, first and second pluralities of slips 18 and 58 are set in casing wall 24 as shown in FIGS. 6 and 12.

Figure 10:
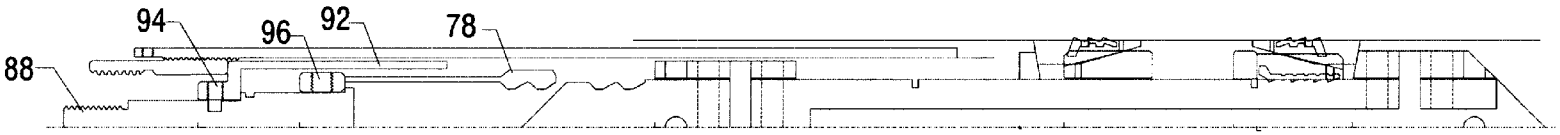
FIG. 10 is a simplified view of the subterranean apparatus and adapter kit according to FIG. 1, shown in a seventh position.
Figure 9:
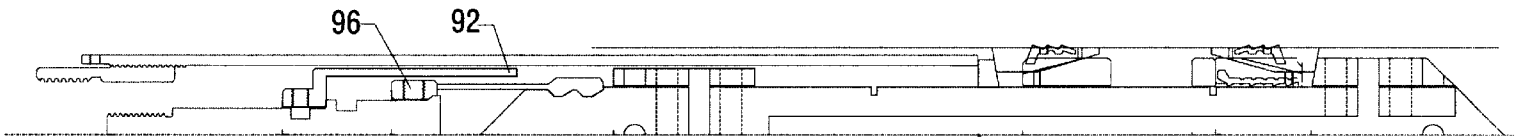
FIG. 9 is a simplified view of the subterranean apparatus and adapter kit according to FIG. 1, shown in a sixth position.
Figure 8:
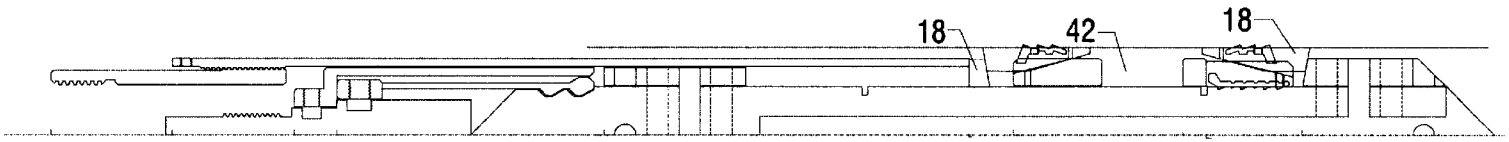
FIG. 8 is a simplified view of the subterranean apparatus and adapter kit according to FIG. 1, shown in a fifth position.
Figure 11:
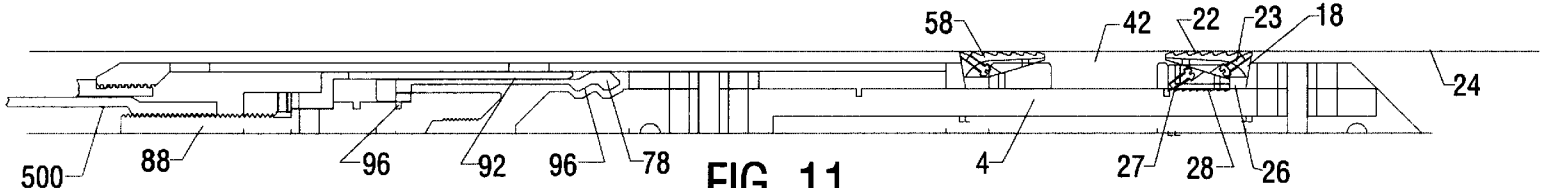
FIG. 11 is a simplified view of a subterranean apparatus and adapter kit assembly positioned in a wellbore according to one embodiment of the present invention.
Figure 17:
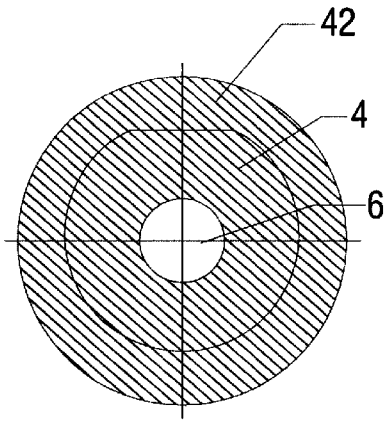
FIG. 17 is a top cross-sectional view of the subterranean apparatus through the mandrel and packing element, according to another alternative embodiment of the present invention.
Figure 16:
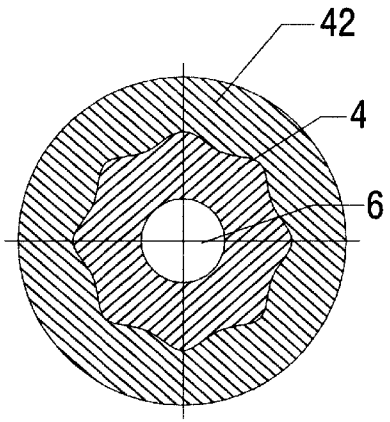
FIG. 16 is a top cross-sectional view of the subterranean apparatus through the mandrel and packing element, according to another alternative embodiment of the present invention.
Figure 15:
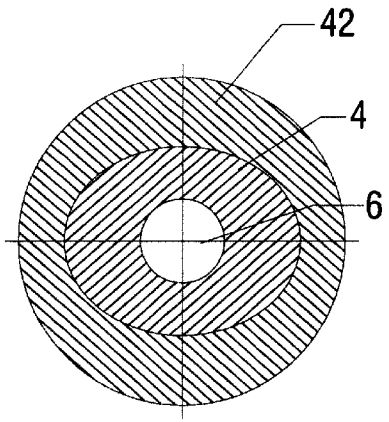
FIG. 15 is a top cross-sectional view of the subterranean apparatus through the mandrel and packing element, according to an alternative embodiment of the present invention.

As the force transmitted by setting sleeve 84 continues to increase, eventually first cone 26 will break and metallic cone inserts 28 collapse on mandrel 4 as shown in FIGS. 7 and 12. First cone 26 may break, for example, at approximately 4500 pounds. As metallic inserts 28 collapse on mandrel 4, the wickers bite into mandrel 4 and lock the mandrel in place with respect to the outer components. Force may continue to increase via setting sleeve 84 to further compress packing element 42 into a sure seal with casing wall 24. Packing element 42 may be completely set at, for example approximately 25,000 pounds as shown in FIG. 8. At this point, setting mandrel 90 begins to try to move uphole via a force supplied by the setting tool (not shown), but metallic inserts 28 in first cone 26 prevent much movement. The uphole force is transmitted via setting mandrel 90 to shear pins 96, which may shear at, for example 30,000 pounds. Referring to FIGS. 9 and 11, as shear pins 96 shear, setting mandrel 90 and support sleeve 92 move uphole. As setting mandrel 90 and support sleeve 92 move uphole, collet 78 is no longer locked, as shown in FIGS. 10 and 11. When collet 78 is exposed, any significant force will snap collet 78 out of recess 76 in mandrel 4 and adapter kit 80 can be retrieved to surface via its attachment to the setting tool (not shown).

With anchoring assembly 16, packing element 42, and first cone metallic insert 28 all set, any pressure build up on either side of plug 2 will increase the strength of the seal. Pressure from uphole may occur, for example, as a perforated zone is fractured.

Figure 20:
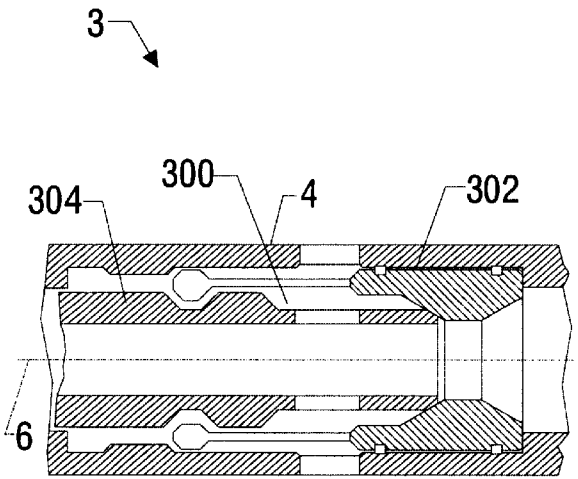
FIG. 20 is a sectional view of the subterranean apparatus according to another alternative embodiment of the present invention.
Figure 19:
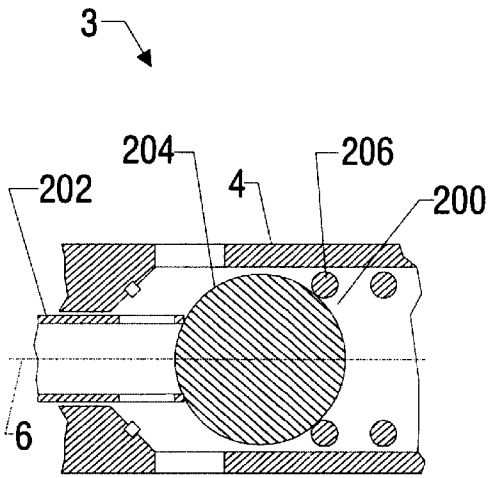
FIG. 19 is a sectional view of the subterranean apparatus according to another alternative embodiment of the present invention.
Figure 18:
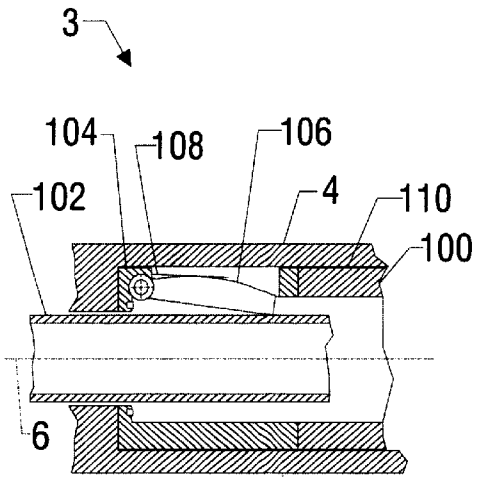
FIG. 18 is a sectional view of the subterranean apparatus according to another alternative embodiment of the present invention.

In an alternative embodiment of the present invention shown in FIGS. 18–20, hole 6 in mandrel 4 may extend all the way through, with a valve such as valves 100, 200, or 300 shown in FIGS. 18–20, being placed in the hole. The through-hole and valve arrangement facilitates the flow of cement, gases, slurries, or other fluids through mandrel 4. In such an arrangement, plug assembly 2 may be used as a cement retainer 3. In the embodiment shown in FIG. 18, a flapper-type valve 100 is disposed in hole 6. Flapper valve 100 is designed to provide a back pressure valve that actuates independently of tubing movement and permits the running of a stinger or tailpipe 102 below the retainer. Flapper valve 100 may include a flapper seat 104, a flapper ring 106, a biasing member such as spring 108, and a flapper seat retainer 110. Spring 108 biases flapper ring 106 in a close position covering hole 6; however a tail pipe or stinger 102 may be inserted into hole 6 as shown in FIG. 18. When tailpipe 102 is removed from retainer 3, spring 108 forces flapper seat 104 closed. In the embodiment shown in FIG. 19, a ball-type valve 200 is disposed in hole 6. Ball valve 200 is designed to provide a back pressure valve as well, but it does not allow the passage of a tailpipe through mandrel 4. Ball valve 200 may include a ball 204 and a biasing member such as spring 206. Spring 206 biases ball 204 to a closed position covering hole 6; however, a stinger 202 may be partially inserted into the hole as shown in FIG. 19. When stinger 202 is removed from retainer 3, spring 206 forces ball 204 to close hole 6. In the embodiment shown in FIG. 20, a slide valve 300 is disposed in hole 6. Slide valve 300 is designed to hold pressure in both directions. Slide valve 300 includes a collet sleeve 302 facilitating an open and a closed position. Slide valve 300 may be opened as shown in FIG. 20 by inserting a stinger 304 that shifts collet sleeve 302 to the open position. As stinger 304 is pulled out of retainer 3, the stinger shifts collet sleeve 302 back to a closed position. It will be understood by one of skill in the art with the benefit of this disclosure that other valve assemblies may be used to facilitate cement retainer 3. The embodiments disclosed in FIGS. 18–20 are exemplary assemblies, but other valving assemblies are also contemplated by the present invention.

Because plug 2 includes all non-metallic components other than metallic inserts 22, 28, and 62, plug assembly 2 may be easily drilled out as desired with only a coiled tubing drill bit and motor. In addition, as described above, all components are rotationally locked with respect to mandrel 4, further enabling quick drill-out. First end cap 10 also rotationally locks with tapered surface 74 of mandrel 4 such that multiple plug drill outs are also advantageously facilitated by the described apparatus.

To further facilitate the drilling out operation, slip 18 and/or slip 58 may include at least one internal cavity. FIGS. 21A–21D illustrate slip 18 or slip 58 having a cavity 33. As previously described, slips 18 are arranged in a ring shown in FIG. 3 with the slips being attached to one another by slip ring 20. In the embodiment shown in FIG. 3, there are six slips 18 arranged in a hexagonal configuration to match the cross-section of mandrel 4. It will be understood by one of skill in the art with the benefit of this disclosure that slips 18 may be arranged in any configuration matching the cross-section of mandrel 4, which advantageously creates a rotational lock such that slips 18 are precluded from rotating with respect to mandrel 4. In addition, the number of slips may be varied and the shape of slip ring may be such that rotation would be allowed between the slips and the mandrel—but for the channels 99 (discussed previously). Further, the configuration of slip ring 20 may be any non-circular shape that precludes rotation between slips 18 and mandrel 4. For example, the slip ring 20 may be square, while mandrel 4 has an outer surface that is hexagonal or octagonal, but rotation between the two is still precluded.

In this embodiment, each of slips 18 is constructed of a brittle, metallic material such as cast iron; however, as would be understood by one of ordinary skill in the art having the benefit of this disclosure, other materials such as ceramics could be utilized. Further, each slip may include a wickered surface to facilitate a locked engagement with a casing wall 24.

Figure 21A:
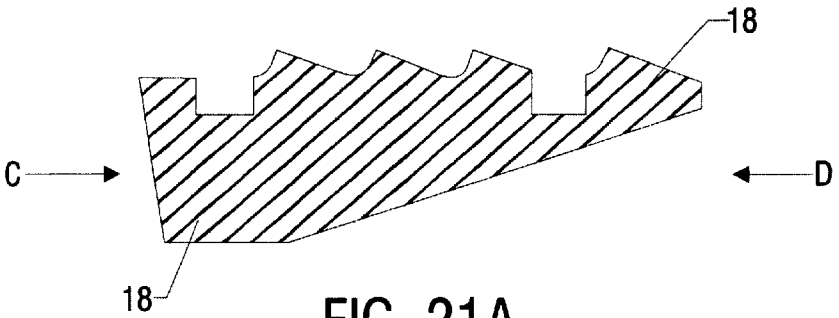
FIGS. 21A–21D show sectional views of the slips of one embodiment of the present invention.
Figure 21B:
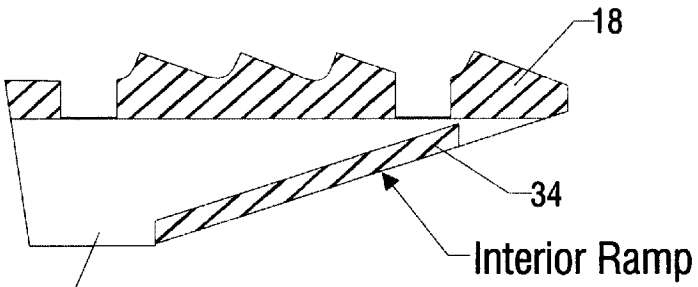
Figure 21C:
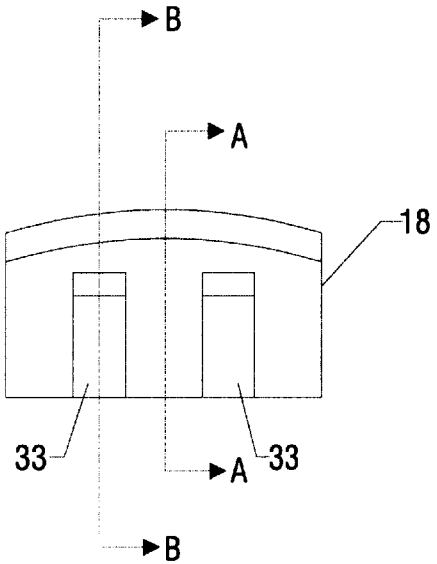
Figure 21D:
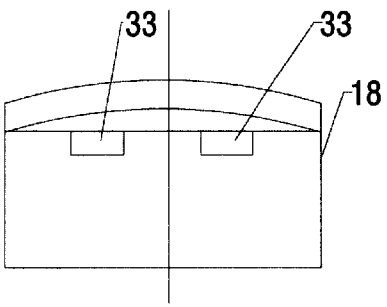

Referring to FIGS. 21A–21D, slip 18 is shown having two lateral cavities 33 in the shape of rectangular slots. FIG. 21A shows a side view of slip 18. FIG. 21B shows a cross section of slip 18. In this configuration, the outer wall of cavity 33 runs parallel to the center line shown in FIGS. 1–14; thus this cavity is a lateral cavity. Also, as best shown in FIGS. 21C and 21D, cavities 33 may be comprised of two slots having a rectangular cross section. However, as would be understood by one of ordinary skill in the art having the benefit of this disclosure, cavities 33 are not limited to being rectangular nor lateral. For instance, cavities 33 could have a square, trapezoidal, or circular cross-section. Cavities 33 could also reside as enclosed cubic, rectangular, circular, polygonal, or elliptical cavities within the slip 18. The cavities 33 could also be vertical, protruding through the wickered surface of the slip 18, or through the interior ramp 34 (discussed hereinafter), or through both. Further, the cavities 33 need not be lateral; the angle of the cavities in the form of slots could be at any angle. For instance, the outer wall of cavity 33 may run perpendicular to the center line shown in FIGS. 1–14, and thus be a vertical cavity. Further, the cavities 33 in the form of slots do not need to be straight, and could therefore be curved or run in a series of directions other than straight. All cavities 33 need not run in the same direction, either. For example, cavities 33 in the shape of slots could run from side-to-side of the slip 18, or at some angle to the longitudinal axis. If the cavities 33 are in the form of enclosed voids as described above, all cavities 33 are not required to be of the same geometry. Any known pattern or in random arrangement may be utilized.

Although two cavities 33 are shown in slip 18 in FIGS. 21A–D, any number of cavities 33 may be utilized.

Cavities 33 are sized to enhance break up of the slip 18 during the drilling out operation. As is known to one of ordinary skill in the art having the benefit of this disclosure, when slip 18 is being drilled, the cavities 33 allow for the slip 18 to break into smaller pieces compared to slips without cavities. Further, enough solid material is left within the slip so as to not compromise the strength of the slip 18 while it is carrying loads.

Also shown in FIG. 21B is the interior ramp 34 of the slip 18 that also enhances plug performance under conditions of temperature and differential pressure. Because it is designed to withstand compressive loads between the slip 18 and the weaker composite material of the cone 26 (mating part not shown, but described above) in service, the weaker composite material cannot extrude into cavities 33 of the slip 18. If this were to occur, the cone would allow the packing element system, against which it bears on its opposite end, to relax. When the packing element system relaxes, its internal rubber pressure is reduced and it leaks.

It should also be mentioned that previous the discussion and illustrations of FIGS. 21A–D pertaining to slips 18 are equally applicable to slips 58 as well.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed methods and apparatus may be utilized in various combinations and/or independently. Thus the invention is not limited to only those combinations shown herein, but rather may include other combinations. For example, the disclosed invention is also applicable to any permanent or retrievable packer taking advantage of the non-circular surfaces so as to improve the millability of each, the invention is not limited to plugs.

What is claimed is:

1. A slip assembly for use on subterranean apparatus comprising:

a first cone with at least one channel therein; and a first plurality of slips, each slip having at least one cavity, the first plurality of slips being arranged about the first cone in the at least one channel of the first cone.

2. The slip assembly of claim 1 further in which each of the first plurality of slips further comprises an interior ramp, each interior ramp adapted to contact the first cone.

3. The slip assembly of claim 1 in which each cavity further comprises a lateral cavity.

4. The slip assembly of claim 1 in which each cavity further comprises a slot.

5. The slip assembly of claim 4 in which each slot has a rectangular cross section.

6. The slip assembly of claim 1 in which the cavity of each slip further comprises two lateral slots, each slot having a rectangular cross section.

7. The slip assembly of claim 6 in which the lateral slots are parallel.

8. The slip assembly of claim 1 in which each slip is comprised of cast iron.

9. The slip assembly of claim 1 further comprising:

a second collapsible cone having at least one channel, and an interior;

a second plurality of slips, each slip having a cavity, the second plurality of slips being arranged about the second collapsible cone in at least one channel of the second collapsible cone, wherein the second collapsible cone is adapted to collapse upon the application of a predetermined force.

10. The assembly of claim 9 in which each cavity in the first and second plurality of slips further comprises a lateral cavity.

11. The slip assembly of claim 9 in which each cavity in the first and second plurality of slips further comprises a slot.

12. The slip assembly of claim 11 in which each slot has a rectangular cross section.

13. The slip assembly of claim 9 in which each cavity in the first and second plurality of slips further comprises two lateral slots, each slot having a rectangular cross section.

14. The slip assembly of claim 13 in which the lateral slots in each slip are parallel.

15. The slip assembly of claim 9 in which each slip is comprised of cast iron.

16. The assembly of claim 9 wherein the first and second pluralities of slips are adapted to traverse first and second cones until the slips lockingly engage with a wellbore wall.

17. The assembly of claim 16 wherein the first and second cones each have a non-circular inner surface such that the shape of the non-circular inner surfaces precludes rotation around a non-circular mandrel.

18. The assembly of claim 17 wherein the non-circular inner surfaces of the first and second cones match the non-circular outer surface of the mandrel.

19. The assembly of claim 1 wherein the first cone has a non-circular inner surface such that the shape of the non-circular inner surface precludes rotation around a non-circular mandrel.

20. A subterranean apparatus having a drillable bridge plug for use within a wellbore comprising:

a mandrel having an outer surface and a non-circular cross-section;

a packing element arranged about the mandrel, the packing element having a non-circular inner surface such that rotation between the mandrel and the packing element is precluded as the outer surface of the mandrel and inner surface of the packing element have matching shapes that interfere with one another in rotation; and an anchoring assembly having a first plurality of slips arranged about the mandrel, the first plurality of slips being configured in a non-circular loop such that rotation between the mandrel and the first plurality of slips is precluded by interference between the loop and the mandrel outer surface, each slip of the first plurality of slips having at least one cavity therein to facilitate subsequent drilling out of the slips.

21. The apparatus of claim 20 wherein the first plurality of slips are arranged in a shape matching the outer surface of the mandrel.

22. The slip assembly of claim 21 further in which each of the first plurality of slips further comprises an interior ramp, each interior ramp adapted to contact the first cone.

23. The apparatus of claim 22 in which each cavity further comprises a lateral cavity.

24. The apparatus of claim 22 in which each cavity further comprises a slot.

25. The apparatus of claim 22 in which each slot has a rectangular cross section.

26. The apparatus of claim 22 in which the cavity of each slip further comprises two lateral slots, each slot having a rectangular cross section.

27. The apparatus of claim 26 in which the lateral slots are parallel.

28. The apparatus of claim 20 in which each slip is comprised of cast iron.

29. The apparatus of claim 20 in which each first plurality of slips further comprises an outer wickered surface engagable with a wellbore wall.

30. The apparatus of claim 29 wherein the first plurality of slips abuts a first cone, the first cone facilitating radial outward movement of the slips into engagement with a wellbore wall upon traversal of the plurality of slips along the first cone.

31. The apparatus of claim 30 wherein the first cone further comprises a plurality of channels, each of the plurality of channels being receptive of at least one of the plurality of slips, the channels being arranged such that rotation between the first cone and the slips is precluded.

32. The apparatus of claim 31 wherein the first cone comprises non-metallic materials.

33. The apparatus of claim 32 further comprising at least one shearing device disposed between the first cone and the mandrel, the at least one shearing device adapted to shear upon the application of a predetermined force.

34. The apparatus of claim 33 further comprising a second plurality of slips arranged about the non-circular mandrel outer surface, the slips being configured in a non-circular loop such that concentric rotation between the mandrel and the first plurality of slips is precluded by interference between the loop shape and the mandrel outer surface shape.

35. The apparatus of claim 34 wherein the slips are arranged in a shape matching the outer surface of the mandrel.

36. The apparatus of claim 35 wherein the second plurality of slips are comprised of cast iron.

37. The apparatus of claim 36 in which the second plurality of slips is engagable with a wellbore wall.

38. The apparatus of claim 37 further comprising a second collapsible cone arranged about the non-circular outer surface of the mandrel, the second collapsible cone comprising a non-cylindrical inner surface such that rotation between the mandrel and second collapsible cone is precluded, wherein a second plurality of slips abuts the second collapsible cone, facilitating radial outward movement of the second plurality of slips into engagement with the wellbore wall upon traversal of the second plurality of slips along the second collapsible cone.

39. The apparatus of claim 38 wherein the non-cylindrical inner surface of the second collapsible cone matches the outer non-circular surface of the mandrel.

40. The apparatus of claim 39 wherein the second collapsible cone comprises non-metallic materials.

41. The apparatus of claim 40 wherein the second collapsible cone is adapted to collapse upon the application of a predetermined force.

42. The apparatus of claim 41 further comprising at least one shearing device disposed between the second collapsible cone and the mandrel, the at least one shearing device being adapted to shear upon the application of a predetermined force.

43. The apparatus of claim 42 further comprising a hole in the mandrel extending at least partially therethrough.

44. The apparatus of claim 43 wherein the hole extends all the way through the mandrel.

45. The apparatus of claim 37 further comprising a second cone arranged about the non-circular outer surface of the mandrel, the second cone comprising a non-cylindrical inner surface such that rotation between the mandrel and second cone is precluded, wherein a second plurality of slips abuts the second collapsible cone, facilitating radial outward movement of the second plurality of slips into engagement with the wellbore wall upon traversal of the second plurality of slips along the second cone.

46. The apparatus of claim 45 wherein the non-cylindrical inner surface of the second cone matches the outer non-circular surface of the mandrel.

47. The apparatus of claim 46 wherein the second cone comprises non-metallic materials.

48. A slip assembly for use on subterranean apparatus comprising:

a first cone with at least one channel therein; and a first plurality of slips, each slip having at least one cavity, the first plurality of slips being arranged about the first cone in the at least one channel of the first cone;

a second cone having at least one channel; and a second plurality of slips, each slip having a cavity, the second plurality of slips being arranged about the second cone in at leas one channel of the second cone.

49. The assembly of claim 48 in which each cavity in the second plurality of slips further comprises a lateral cavity.

50. The slip assembly of claim 49 in which each slip is comprised of cast iron.

51. A slip assembly for use on subterranean apparatus comprising:

a first cone with at least one channel therein; and a first plurality of slips, each slip having at least one longitudinal cavity running substantially the length of the slip, the first plurality of slips being arranged about the first cone in the at least one channel of the first cone.

52. The slip assembly of claim 51 further in which each of the first plurality of slips further comprises an interior ramp, each interior ramp adapted to contact the first cone.

53. The slip assembly of claim 51 in which each cavity further comprises a lateral cavity.

54. The slip assembly of claim 51 in which the cavity of each slip further comprises two lateral slots, each slot having a rectangular ross section.

55. The slip assembly of claim 51 in which each slip is comprised of cast iron.

56. The slip assembly of claim 51 further comprising:

a second cone having at least one channel;

a second plurality of slips, each slip having at least one longitudinal cavity running substantially the length of the slip, the second plurality of slips being arranged about the second cone in at least one channel of the second cone.

57. The assembly of claim 56 in which each cavity in the second plurality of slips further comprises a lateral cavity.

58. The slip assembly of claim 56 in which each slip is comprised of cast iron and the second cone is collapsible.

59. A slip assembly for use on subterranean apparatus comprising:

a first cone with at least one channel therein; and a first plurality of slips, each slip having wickers and at least one internal cavity immediately adjacent the wickers, the first plurality of slips being arranged about the first cone in the at least one channel of the first cone.

60. The slip assembly of claim 59 further in which each of the first plurality of slips further comprises an interior ramp, each interior ramp adapted to contact the first cone.

61. The slip assembly of claim 59 in which each cavity further comprises a lateral cavity.

62. The slip assembly of claim 59 in which the cavity of each slip further comprises two lateral slots, each slot having a rectangular cross section.

63. The slip assembly of claim 59 in which each slip is comprised of cast iron.

64. The slip assembly of claim 59 further comprising:

a second cone having at least one channel;

a second plurality of slips, each slip having wickers and an internal cavity immediately adjacent the wickers, the second plurality of slips being arranged about the second cone in at least one channel of the second cone.

65. The assembly of claim 64 in which each cavity in the second plurality of slips further comprises a lateral cavity.

66. The slip assembly of claim 64 in which each slip is comprised of cast iron and the second cone is collapsible.

67. A slip assembly for use on subterranean apparatus comprising:

a first cone with at least one channel therein; and a first plurality of slips, each slip and at least one hollow cavity to enhance break up of the slip during a removal operation, the first plurality of slips being arranged about the first cone in the at least one channel of the first cone.

68. The slip assembly of claim 67 further in which each of the first plurality of slips further comprises an interior ramp, each interior ramp adapted to contact the first cone.

69. The slip assembly of claim 67 further in which each cavity further comprises a lateral cavity.

70. The slip assembly of claim 67 in which the cavity of each slip further comprises two lateral slots, each slot having a rectangular cross section.

71. The slip assembly of claim 67 in which each slip is comprised of cast iron.

72. The slip assembly of claim 67 further comprising:

a second cone having at least one channel;

a second plurality of slips, each slip having a hollow cavity to enhance break up during the removal operation, the second plurality of hollow slips being arranged about the second cone in at least one channel of the second cone.

73. The assembly of claim 72 in which each cavity in the second plurality of slips further comprises a lateral cavity.

74. The slip assembly of claim 72 in which each slip is comprised of cast iron and the second cone is collapsible.

* * * * *